United States Patent [19]

Zahn

[11] 4,129,941

[45] Dec. 19, 1978

[54] SPLICE GUN

[75] Inventor: Irwin Zahn, New York, N.Y.

[73] Assignee: General Staple Company, Inc., New York, N.Y.

[21] Appl. No.: 842,572

[22] Filed: Oct. 17, 1977

[51] Int. Cl.[2] ..... H01R 43/04

[52] U.S. Cl. ..... 29/753; 227/90; 227/138; 206/409

[58] Field of Search ..... 227/90, 138, 136; 29/751, 753, 761, 630 F; 206/330, 409; 226/67, 68, 70, 71

[56] References Cited

U.S. PATENT DOCUMENTS

| | | | |
|---|---|---|---|
| 705,433 | 7/1902 | Packer | 227/90 |
| 1,657,133 | 1/1928 | Newhouse | 227/90 |
| 3,009,156 | 11/1961 | Lerner | 227/138 |
| 3,517,804 | 6/1970 | Faulkner | 206/409 |
| 3,753,279 | 8/1973 | Eppler | 29/753 |
| 3,783,490 | 1/1974 | Garfinkel | 29/753 |
| 3,993,232 | 11/1976 | White | 226/70 |

*Primary Examiner*—Lowell A. Larson

*Attorney, Agent, or Firm*—Lerner, David, Littenberg & Samuel

[57] ABSTRACT

Apparatus is disclosed for forming electrical splices from a continuous supply band. The apparatus includes feeding means for feeding a preselected length of the supply band to a forming station; clinching means positioned beneath the forming station; forming means for forming said preselected length into a generally U-shaped configuration; driving means for driving the U-shaped configuration into the clinching means; and operating means for simultaneously moving the forming means and the driving means in a forward direction for a reselected length of travel sufficient to effect formation of said U-shaped configuration by said forming means for thereafter moving only said driving means in said forward direction to drive said U-shaped configuration into said clinching means. A removable container is also disclosed which houses the continuous supply band of electrically conductive material from which the splices are formed in the apparatus with which the container is associated. The housing has an exit passageway through which the supply band may pass, and further includes feeding means carried by the housing for advancing preselected lengths of the supply band through the exit passageway and into the associated splice-forming apparatus. A supply band is also disclosed for use with such an apparatus for forming electrical splices therefrom, the supply band comprising a continuous length of flat electrically conductive material having notches at preselected locations along the length thereof. The distance between each pair of adjacent notches corresponds to the preselected length which is fed from the aforementioned container into the apparatus from which an electrical splice is formed and driven about a pair of electrical wires to be connected.

17 Claims, 5 Drawing Figures

SPLICE GUN

FIELD OF THE INVENTION

This invention relates to apparatus for automatically forming electrical splices from a continuous supply band; more particularly relates to such apparatus which includes improved simplified operating mechanism therein; and further includes such an apparatus which operates from removable disposable cassette-like storage containers for such supply band; and an improved supply band utilized in conjunction with such containers.

BACKGROUND OF THE INVENTION

In U.S. Pat. No. 3,636,611, issued Jan. 25, 1972, to Irving W. Rosenbaum, entitled "Apparatus for Splicing Wires" and assigned to the assignee of the instant invention, there is disclosed apparatus for automatically forming, driving and crimping an electrically conductive splice about a pair of wires which are to be mechanically and electrically connected thereby. A significant advantage of the apparatus described in the Rosenbaum patent is the fact that the apparatus employs a continuous supply strip and automatically forms, drives and crimps the splice formed therefrom in one continuous operation. Similarly, in U.S. Pat. No. 3,605,261, issued Sept. 20, 1971, to I. Zahn, et al., and assigned to the assignee of the instant invention, there is disclosed apparatus for automatically forming, driving and crimping a terminal about the end of a wire in one continuous operation and with the employment of a continuous supply strip. Likewise, in U.S. Pat. No. 3,849,860, issued Nov. 26, 1974, to I. Zahn, et al., and assigned to the assignee of the instant invention, there is disclosed apparatus for automatically forming, driving and crimping a strain relief splice about the end of a wire in one continuous operation and with the employment of a continuous supply strip. Other patents issued to the assignee of the present invention relate to the application of insulated splices which are formed, driven and crimped about the ends of one or more wires in a continuous operation and with the employment of a continuous supply strip.

Although the structures of the aforementioned patents have met with commercial success, there have been drawbacks associated with such apparatus which the instant invention seeks to eliminate.

For example, in each of the aforementioned structures, a pair of former bars are reciprocally driven to form a generally U-shaped configuration. Reciprocally mounted for sliding motion between the former bars is a driving ram which acts to drive the U-shaped configuration into a clinching die and about the wire or wires about which the crimped splice is to be applied. The former bars and driving ram are operated off of separate drive cams, each include separate linking structure to connect the appropriate drive cam with the former bars or driving ram respectively, and such drive cams and linking mechanisms must be timed with respect to one another to achieve the desired sequence of operations.

It can be appreciated that such complexity is not only undesirable from its own point of view, but increases the risk of potential break-down, and encourages a certain degree of sloppiness or "play", especially over extended periods of use.

Another potential area of concern associated with the apparatus of the aforementioned patents relates to the feeding mechanism for sequentially advancing lengths of the continuous supply band into the forming station of the apparatus. A pair of feed cams are rotated, once for each cycle of operation, to sandwich the supply band therebetween for a limited degree of their travel, and thereby advance a preselected length of the supply band into the forming station where it is severed, formed, driven and clinched. Here, again, the inclusion of a positively actuated feed mechanism which must be synchronized with the remaining portions of the apparatus increases the risk and incidence of malfunction. Additionally, the supply band itself has been generally in the form of an endless coil of wire which is hung on a spindle and, thereafter, must be threaded through the aforementioned cam wheels, a series of tubular guides, and then finally into the forming station of the apparatus itself. Such a procedure is not only time consuming, but requires a certain degree of dexterity and competence which is not necessarily possessed by the average worker employing such apparatus on a production line.

SUMMARY OF THE INVENTION

The instant invention represents an improvement over the apparatus of the aforementioned patents in a number of respects. First of all, and unlike the apparatus of the prior patents, the former bars and driving ram are operated by common mechanism which causes the former bars and driving ram to move together for a preselected length of travel, sufficient to effect formation of the U-shaped configuration by the former bars and for thereafter moving only the driving ram to drive the U-shaped configuration into the clinching die. As will be appreciated hereinafter, such single stroke operation is materially simpler than the prior machines, includes fewer parts, and is less susceptible to the problems noted above.

With respect to the feeding apparatus, and as will be described in greater detail hereinafter, the instant invention provides for a removable, disposable, cassette-like container for the continuous supply band employed in the apparatus, which container includes its own feeding mechanism associated therewith. When the container is affixed to the apparatus, alignment means associated with the container and the apparatus guarantees that the exit passageway from the container will be aligned with the entrance to the forming station of the apparatus and, at the same time, the self-contained feeding mechanism associated with the container will be automatically and properly positioned with respect to the operating mechanism of the apparatus such that automatic feeding will occur upon the next cycle of operation of the apparatus.

Still further, the instant invention provides an improved supply band for use in the aforementioned container, the supply band comprising a continuous length of flat, electrical conductive material having notches at preselected locations along the length thereof with the distance between each pair of adjacent notches corresponding to the preselected length from which the apparatus forms electrical splices. The feeding means associated with the aforementioned storage container includes a portion thereof which advances the supply band by engaging the notches thereof.

As a further feature of the instant invention, the entire mechanism is pneumatically operated as aforedescribed in a single stroke operation, and therefore eliminates much of the mechanism associated with the appartus of the aforementioned patents such as rotating shafts, clutches, etc.

Accordingly, it is an object of the instant invention to provide an improved apparatus for automatically forming, driving and crimping a splice or terminal about the end of one or more wires in a continuous operation with the employment of a continuous supply strip.

Another object of the instant invention is to provide such an improved apparatus which employs a single stroke operation to form and drive such a splice.

Still another object of the instant invention is to employ such a single stroke operation which is pneumatically driven.

Yet another object of the instant invention is to provide such an improved apparatus which employs a removable cartridge-like container which stores the continues supply band employed by such apparatus to form splices.

Still another object of the instant invention is to provide such an apparatus which employs a cartridge-like container which includes a self-contained feeding mechanism by which the supply band stored therein may be sequentially advanced into the forming station associated with the apparatus.

Yet another object of the instant invention is to provide such an apparatus including a removable cartridge-like storage container having its own feeding means associated therewith which employs alignment means to properly position the exit passageway of the container and the feeding means associated therewith with respect to the appropriate portions of the apparatus in conjunction with which the container is employed.

Still another object of the instant invention is to provide an improved supply band for use in the aforementioned cartridge-like container.

These and other objects of the instant invention will become apparent upon consideration of the accompanying detailed description and drawings.

DETAILED DESCRIPTION OF THE INVENTION

Figure 1:
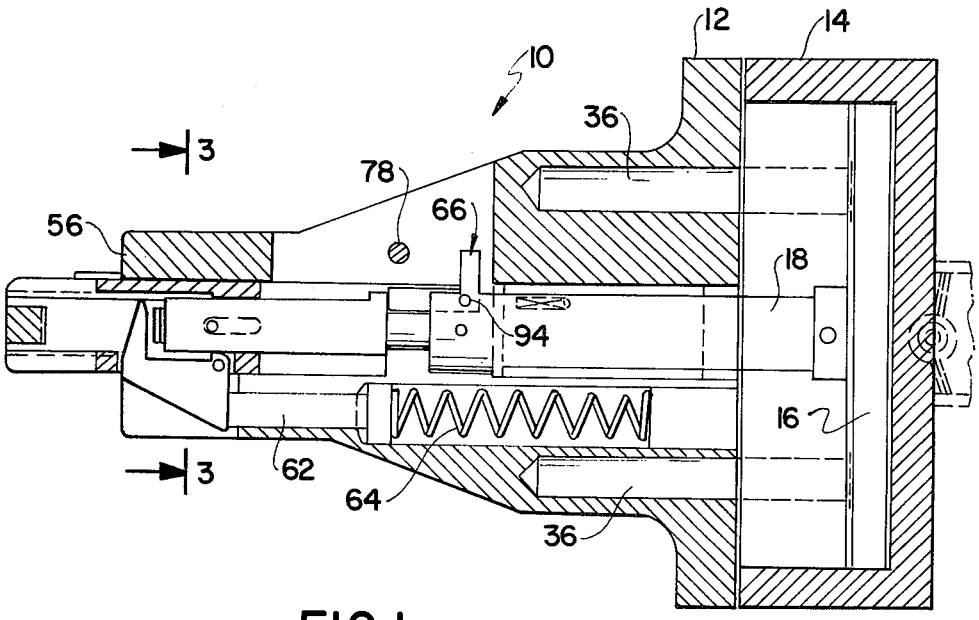
FIG. 1 is a plan view, partly in section, of the novel apparatus of the present invention.

Turning to the figures, wherein like parts are designated by like reference numerals, there is shown apparatus 10 constructed in accordance with the instant invention. Generally speaking, the apparatus includes a frame 12 on the rear portion of which is disposed a piston cylinder 14. Located within cylinder 14 is a piston 16 to which is secured piston rod 18 which extends out of the piston cylinder 14. As will be explained in greater detail, it is the reciprocal linear motion of the piston rod 18 which effects operation of the apparatus 10. In accordance with a preferred embodiment of the present apparatus, such single stroke reciprocally sliding motion is most advantageously accomplished by employing a pneumatic mode of operation.

Figure 2:
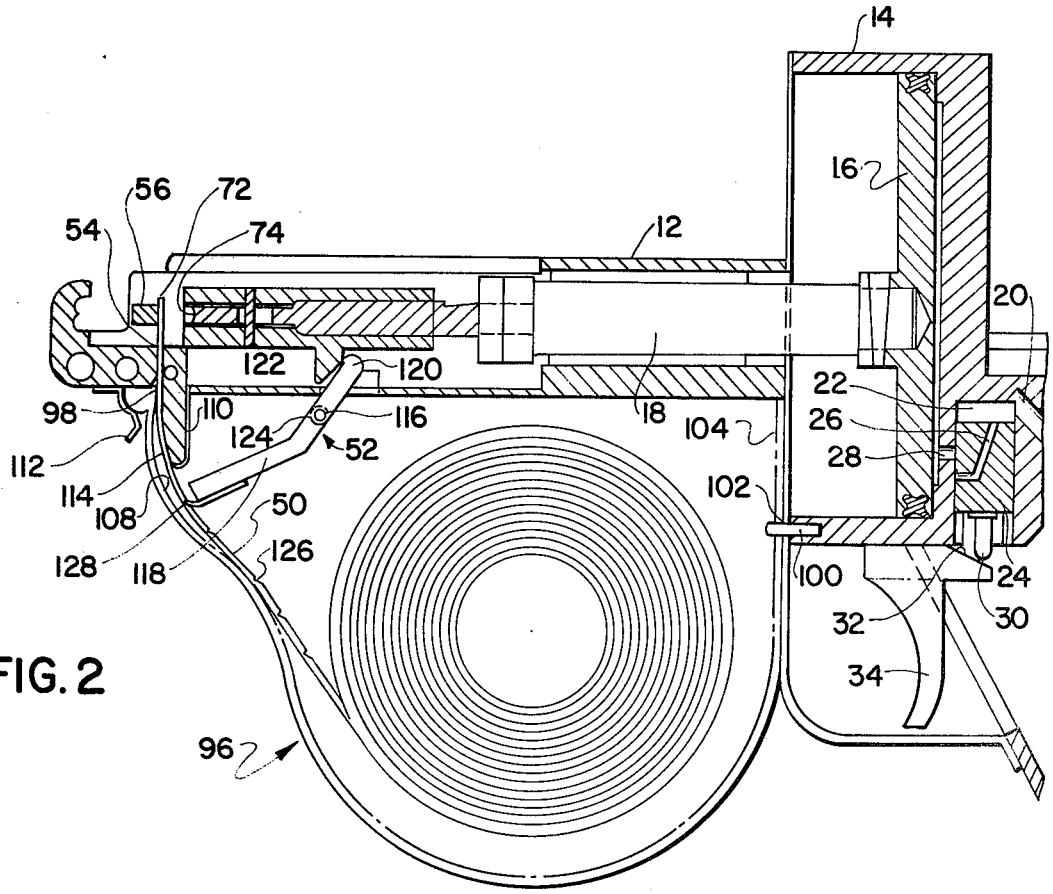
FIG. 2 is a side view, partly in section of the novel apparatus of the instant invention, and further illustrating the use of the novel cartridge-like storage container and improved supply band associated therewith.

Thus, as best seen in FIG. 2, a source of fluid under pressure, such as air, (not shown) is led through passageway 20 into communication with cavity 22 within which is slidable a conventional pneumatic valve schematically illustrated as 24. Valve 24 includes a passageway designated 26 therethrough which, when the valve 24 is in the up position as viewed in FIG. 2, will connect the passageway 20 to an opening 28 which communicates with the piston cylinder 14 on the rearward side of the piston 16. Valve 24 includes a depending finger 30 which engages a cam surface 32 provided on a trigger finger 34 which is normally biased (by a biasing spring not shown) to the position illustrated in FIG. 2. Of course, when trigger 34 is squeezed, the cam surface 32 drives the finger 30 and valve 24 upwardly to communicate the passage 20 with the opening 28 and allow air under pressure to enter the cylinder 14 and drive the piston 16 to the left as viewed in FIG. 2. The return of piston 16 is accomplished by return springs 36 as clearly seen in FIG. 1.

It should be noted that although pneumatic operation is preferred (since linear reciprocal motion of the piston rod 18 is desired), other types of driving mechanism could be employed so long as the resultant mechanical output were such as to be capable of driving piston rod 18 in a reciprocating fashion.

Figure 3:
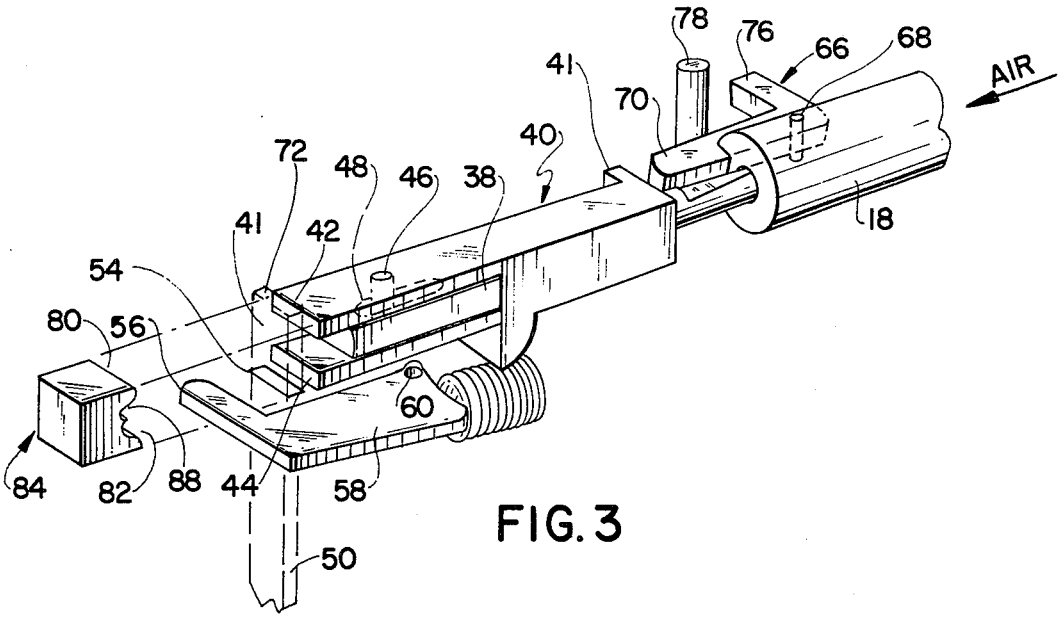
FIG. 3 is an exploded perspective view of a portion of the apparatus of the instant invention.

As shown in the drawings, and perhaps most clearly in FIG. 3, at the end of piston rod 18 there is provided a driving ram 38. The driving ram 38 is positioned and movable relative to a generally U-shaped former element 40 which, as best seen in FIG. 3, includes a bite portion 41 and a pair of former bars 42 and 44 which upstand from opposite ends of the bite portion 41. A pin 46 passes from one former bar 42 to the opposite former bar 44, passing through an elongated slot 48 provided in the driving ram 38. Thus, it may be appreciated that for at least that distance which corresponds to the length of the slot 48, the driving ram 38 and former bars 40, 42 would normally be free to slide linearly relative to one another.

As mentioned hereinbefore, the present apparatus forms electrical splices from a continuous supply band designated 50 in FIGS. 2 and 3. The details of advancing the supply band 50 into the apparatus will be further explained with respect to FIG. 2. However, for present purposes, it will be noted that the supply band 50 is advanced by feeding mechanism broadly designated 52 in FIG. 2, through an entrance slot 54 in the frame 12, and across the nose 56 of an anvil 58 mounted for pivotal movement at 60 on the frame 12. It may be noted that the anvil 58 is maintained in its normal supporting position by a plunger 62 biased to the left in FIG. 1 by spring 64.

Pivotally mounted on the driving ram 18 is a bell crank 66, the function of which is to link the forward travel of former bars 42, 44 with the forward travel of driving ram 38 at least for a predetermined distance. To that effect, the bell crank 66 is pivotally pinned to the piston rod 18 at 68 and includes a driving arm 70 which normally engages the bite portion 41 of the U-shaped former element 40 when the bell crank 66 is in the position illustrated in FIG. 3. Thus, it will be appreciated that when the apparatus is in the condition illustrated in FIG. 3, downward motion of the piston rod 18 will, through the vehicle of the linking bell crank 66, also drive the U-shaped forming element 40 with its former bars 42 and 44 in a downward direction for as long as the arm 70 of bell crank 66 remains in the position illustrated in FIG. 3.

During such downward path of travel, two things occur. First, as best seen in FIG. 2, the former bar 42 shears a length 72 from the supply band 50 as it passes the extremity of the entrance passageway 54 in the frame 12. Simultaneously, the two former bars 42 and 44 bend the length 72 around the nose 56 of the anvil 58 so that the length 72 assumes the generally U-shaped configuration illustrated in FIG. 4. It should be noted that the spring 64 is sufficiently strong to maintain the anvil 58 in its supporting position while the sides of the length 72 are draped about the nose 56 of the anvil 58. Also, it should be noted, as seen in FIG. 2, that the bottom surface 74 of the driving ram 38 is initially positioned to the right of the bottom of former bars 42 and 44 as viewed in FIG. 2, such that during the forming operation, the driving ram 38 does not engage the crown of the U-shaped splice 72 being formed in the manner shown in FIG. 4.

Figure 4:
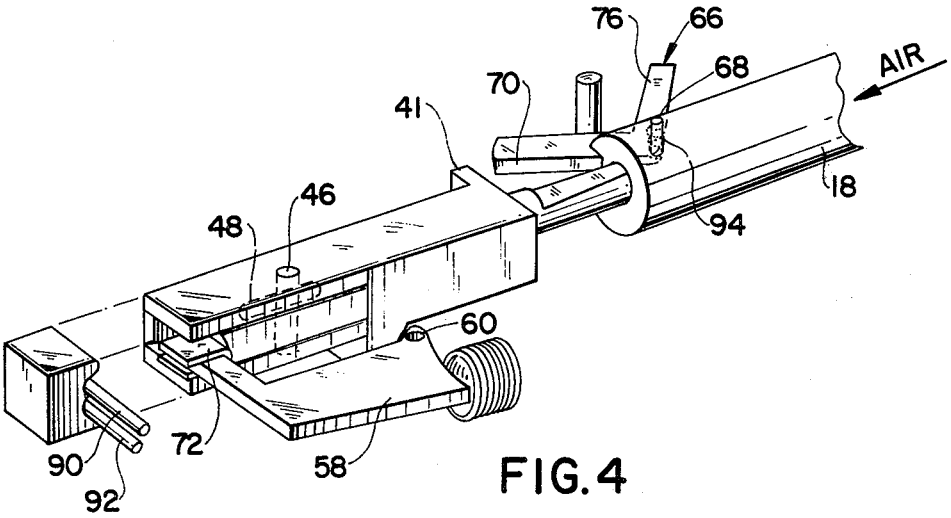
FIG. 4 is an exploded perspective view of a portion of the apparatus illustrated in FIG. 3 at a different point in the operation thereof.

Continuing operation, just as the formation of the U-shaped splice 72 is completed, the free arm 76 of the bell crank link 66 engaged fixed stop 78 positioned in the frame 12. This causes bell crank 66 to rotate clockwise as viewed in FIG. 1 to disengage the driving arm 70 of bell crank 66 from the bite portion 41 of the U-shaped forming element 40. Thus, it will be appreciated that with the bell crank 66 rotated to the clockwise position illustrated in FIG. 4, any further downward stroke of the piston rod 18 and accompanying downward travel of the driving ram 38 will have no driving effect on the former element 40 which remains at rest with the bottom surfaces of the former bars 42 and 44, resting on the upper surfaces 80 and 82 of the clinching die 84 positioned beneath the forming station. The condition of the apparatus at the point where the splice 72 has been formed into its U-shaped configuration, with the bell crank lever 66 rotated to disengage the driving arm 70, with the former bars 42 and 44 coming to rest on the surfaces 80 and 82 of the clinching die 84 is illustrated in FIG. 4.

Figure 5:
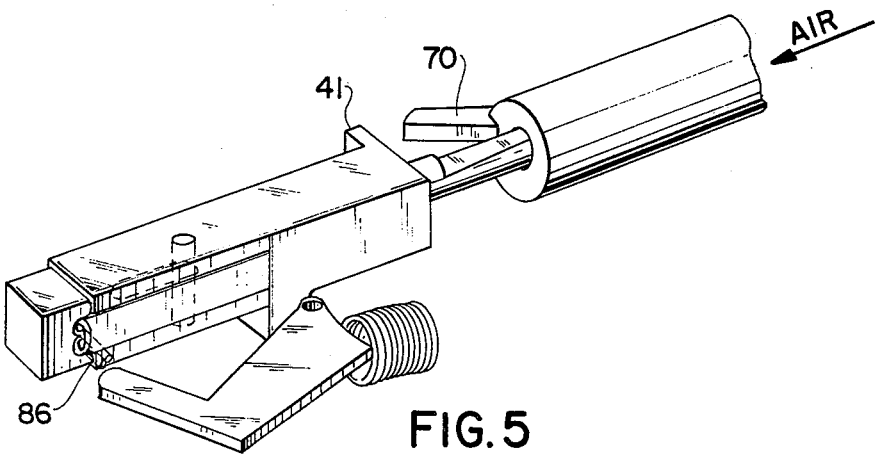
FIG. 5 is an exploded perspective view of a portion of the apparatus illustrated in FIGS. 3 and 4, and further illustrating the operation thereof at a different stage in its cycle.

Continuing with the sequence of operation, continued motion of the piston rod 18, with the driving ram 38 attached thereto, causes the undersurface 74 of the driving ram to engage the crown 86 of the U-shaped splice 72. As the driving ram 38 descends, it rotates the anvil 58 counterclockwise as viewed in FIG. 5, and thereafter drives the U-shaped splice into the double cusp cavity 88 in the clincher 84 and crimps same around the wire or wires, 90, 92, which have been positioned in the cavity. At that point, the formation of the splice is complete.

When the piston rod 18 recycles in the reverse direction, initially, the driving ram 38 will move upwardly as viewed in FIG. 3 until such time as the pin 46 engages the upper surface of the elongated slot 48 in the former bars 42 and 44. Thereafter, continued upward movement of the driving ram 38 will also be accompanied by upward movement of the forming element 40. Also, it will be appreciated that during the initial period of upward travel of the ram 38 relative to the former element 40 (before the pin 46 engages the upper end of the slot 48), sufficient distance will have been traveled by the ram 38 to permit a biasing spring 94 to return the bell crank 66 to the position illustrated in FIG. 3 so that the unit will be ready for the next cycle of operation.

Turning to FIG. 2, it will be seen that the supply band 50 is housed in rolled form in a container 96 having an exit passageway 98 positioned adjacent the entrance slot 54 to the forming station of the apparatus 10 when the container 96 is secured to the frame. The container is removably securable to the frame 12 by virtue of securing means including a pin 100 carried by the frame 12 which is received in an aperture 102 in the rear wall 104 of the container 96, and further by virtue of an enlarged portion 106 of the forward wall 108 of the container 96 being frictionally retained between a fixed depending projection 110 carried by the frame 12 and a resilient leaf-spring like retaining element 112 secured to the frame 12. It will be appreciated that the curved forward surface 114 of the depending projection 110 functions as a guiding surface for the supply band 50 as it exits the container 96 and enters the slot 54 on its travel to the forming station of the apparatus 10.

The feeding means 52 is pivotally secured to the container 96 at 116 and includes a first end portion 118 which engages the supply band 50 to advance same when the second end portion 120 thereof is moved clockwise with respect to the pivot point 116 by a depending actuating arm 122 carried by former bar 42. A small biasing spring 124 normally urges the feeding means 52 counterclockwise as viewed in FIG. 2.

As will now be apparent from FIG. 2, the feeding operation occurs when the apparatus is operating in its retracting cycle. That is to say, during the rearward travel of the forming element 40, the arm 122 depending from former bar 42 engages the second end portion 120 of the feeding means 52 to rotate same clockwise around its pivot point 116 to advance the supply band by the preselected length corresponding to the length 72 illustrated in FIG. 3. When the apparatus is operated and the former element 40 is moving to the left as viewed in FIG. 2, the spring 124 will rotate the feed means 52 counterclockwise to reset it for a subsequent feeding operation during the next retraction cycle.

As can also be seen in FIG. 2, the novel supply band 50 hereof includes notches 126 with a distance between each pair of adjacent notches corresponding to the preselected length of supply band 72 (see FIG. 4) upon which the apparatus will operate to form an electrical splice. In this connection, the first end portion 118 of the feeding means 52 carries a thin extension 128 which engages a notch 126 to drive the band 50 when the feeding mechanism 52 is rotated in a clockwise direction. However, because of the orientation of the extension 128, it is free to travel in an opposite direction along the inner surface of the supply band 50 when the feeding mechanism 52 reverts counterclockwise back to its normal position under the influence of the spring 124.

It will be appreciated that when the container 96 runs out of the supply band 50, the operator merely snaps off the container 96 (and may dispose of same if it is so desired) and replaces it with a new container 96 which, as noted, includes its own self-contained feeding means and is automatically self-aligned with respect to the apparatus 10 when it is positioned on the frame 12. In this sense, the container 96 may be thought of as a removable, disposable cartridge-like container, a great number of which may be supplied along with the basic apparatus 10.

Although this invention has been described with respect to its preferred embodiments, it should be understood that many variations and modifications will now be obvious to those skilled in the art, and it is preferred, therefore, that the scope of the invention be limited, not by the specific disclosure herein, only by the appended claims.

What is claimed is:

1. Apparatus for forming electrical splices from a continuous supply band; said apparatus comprising:

feeding means for feeding a preselected length of said supply band to a forming station;

clinching means positioned beneath said forming station;

forming means for forming said preselected length into a generally U-shaped configuration;

driving means for driving said U-shaped configuration into said clinching means, said driving means being disposed within said forming means;

operating means for simultaneously moving said forming means and said driving means is a forward direction for a preselected length of travel sufficient to effect formation of said U-shaped configuration by said forming means and for thereafter moving only said driving means in said forward direction to drive said U-shaped configuration into said clinching means; and said operating means including piston means extending through said forming means and being directly connected to said driving means disposed within said forming means.

2. The apparatus of claim 1 wherein said forming station includes an anvil normally positioned to support said preselected length of said supply band when said forming means forms said length into said U-shaped configuration, said anvil being movable from its said normal position when said driving means drives said U-shaped configuration into said clinching station.

3. The apparatus of claim 1 wherein said forming means includes a pair of spaced apart and connected former bars, said driving means includes a driver ram positioned between said former bars and connected directly to said piston means for reciprocal sliding motion of said driver ram with respect to said former bars, and said operating means includes linking mechanism for effecting forward motion of said former bars with forward motion of said driver ram for said preselected length of travel, said linking mechanism becoming disconnected after said preselected length of travel so that continued forward motion of said driver ram will drive said U-shaped configuration into said clinching means.

4. The apparatus of claim 3 wherein said driver ram includes an elongated slot therein, and further including an elongated pin passing between said former bars through said slot; whereupon motion of said driver ram in a second direction will effect motion of said former bars in said second direction.

5. The apparatus of claim 4 wherein said linking mechanism includes a bell crank pivotally connected to said driving means, said bell crank having first and second arms, said first arm normally engaging said forming means to drive said forming means upon forward motion of said driving means, said second arm being engaged by a fixed stop to cause rotation of said bell crank and disconnection of said first arm thereof from said forming means after said preselected length of travel.

6. The apparatus of claim 3 wherein said linking mechanism includes a bell crank pivotally connected to said driving means, said bell crank having first and second arms, said first arm normally engaging said forming means to drive said forming means upon forward motion of said driving means, said second arm being engaged by a fixed stop to cause rotation of said bell crank and disconnection of said first arm thereof from said forming means after said preselected length of travel.

7. The apparatus of claim 1 wherein said driving means is driven by a pneumatically operated piston.

8. The apparatus of claim 1 wherein said driving means is reciprocally movable in its said forward direction toward said clinching means and in a second direction opposite said forward direction; and further including actuating means for operating said feeding means to feed a new preselected length of said supply strip to said forming station when said driving means is moving in its said second direction.

9. The apparatus of claim 3 wherein said driving means is reciprocally movable in its said forward direction toward said clinching means and in a second direction opposite said forward direction; and further including actuating means for operating said feeding means to feed a new preselected length of said supply strip to said forming station when said driving means is moving in its said second direction.

10. The apparatus of claim 9 wherein said driver ram includes an elongated slot therein, and further including an elongated pin passing between said former bars through said slot; whereupon motion of said driver ram in said second direction will effect motion of said former bars in said second direction, and wherein said actuating means includes an actuating arm carried by said former bars, said arm operating said feeding means when said former bars move in said second direction.

11. The apparatus of claim 8, and further including a frame, and wherein said supply band is housed in a container removably secured to said frame; said container having an exit passageway positioned adjacent said forming station when said container is secured to said frame; said container carrying said feeding means.

12. The apparatus of claim 11 wherein said feeding means includes a first end portion which engages and advances said supply band by said preselected length.

13. The apparatus of claim 10, and further including a frame, and wherein said supply band is housed in a container removably secured to said frame; said container having an exit passageway positioned adjacent said forming station when said container is secured to said frame; said container carrying said feeding means; and wherein said feeding means includes a first end portion which engages and advances said supply band by said preselected length; and wherein said feeding means includes a second end portion which protrudes out of said container into the path of travel of said actuating arm when said former bars move in said second direction.

14. The apparatus of claim 11 wherein said frame and said container include cooperating alignment means for aligning said exit passageway with the entrance to said forming station.

15. A container for housing a continuous supply band, said container comprising:

a housing for storing said supply band, said housing having an exit passageway through which said band may pass;

feeding means carried by said housing for advancing preselected lengths of said band through said exit passageway;

said feeding means including a first end portion which engages and advances said supply band by said preselected length and a second end portion which protrudes out of said housing;

movement of said second end portion of said feeding means effecting movement of said first end portion of said feeding means to advance said supply band;

said container including means for removably securing said container to apparatus which forms electrical splices from said supply band;

said apparatus including reciprocating forming and driving means for forming splices from said preselected lengths of supply band; and said second end portion of said feeding means being actuated by said reciprocating forming means when said reciprocating forming means is retracted after performing its forming operation and when said container is secured to said apparatus.

16. The container of claim 15 wherein said container includes means for removably securing said container to apparatus which forms electrical splices from said supply band.

17. The container of claim 16 wherein said container includes alignment means for aligning said exit passageway with the entrance to a forming station located in said apparatus.

* * * * *

UNITED STATES PATENT AND TRADEMARK OFFICE

CERTIFICATE OF CORRECTION

PATENT NO. : 4,129,941

DATED : December 19, 1978

INVENTOR(S) : Irwin Zahn

It is certified that error appears in the above-identified patent and that said Letters Patent are hereby corrected as shown below:

Claim 1, line 17, "is" should read -- in --.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*